US005422144A

United States Patent [19]

Speakman, Jr.

[11] Patent Number: 5,422,144

[45] Date of Patent: Jun. 6, 1995

[54] SUBSTRATE COATING METHOD

[75] Inventor: Edward J. Speakman, Jr., Ontario, N.Y.

[73] Assignee: Xerox Corporation, Stamford, Conn.

[21] Appl. No.: 355,715

[22] Filed: Dec. 14, 1994

[51] Int. Cl.[6] ..... B05D 1/18

[52] U.S. Cl. ..... 427/430.1

[58] Field of Search ..... 427/430.1

[56] References Cited

U.S. PATENT DOCUMENTS 5,244,697 9/1993 Vackler et al. ..... 427/430.1

*Primary Examiner*—Bernard Pianalto

*Attorney, Agent, or Firm*—Zosan S. Soong

[57] ABSTRACT

There is disclosed a substrate coating method comprising: (a) enclosing a portion of a substrate in a sleeve member to define a gap between the outer surface of the substrate and the inner surface of the sleeve member; (b) positioning below the surface of a coating solution a portion of the sleeve member and a portion of the substrate and filling a portion of the gap with the coating solution, whereby a part of the sleeve member outer surface, a part of the sleeve member inner surface, and a part of the substrate outer surface contact the coating solution; and (c) withdrawing the coating solution from the gap and leaving a portion of the coating solution adhering to the outer surface of the substrate.

13 Claims, 2 Drawing Sheets

SUBSTRATE COATING METHOD

This invention relates generally to a method for coating the peripheral surface of a substrate such as a drum, and more particularly to a coating method for the fabrication of a photosensitive member useful in the field of electrostatography.

Conventional dip coating methods are problematic in that they generally involve the direct immersion of a substrate into the coating solution where surface contaminates and/or vibrational effects may be undesirable in the resulting coating on the substrate.

A conventional dip coater is illustrated in Vackler et al., U.S. Pat. No. 5,244,697.

SUMMARY OF THE INVENTION

It is an object in embodiments of the instant invention to provide a substrate coating method which minimizes or eliminates the presence of surface contaminates in the resulting coating and the effects of vibration on the resulting coating.

These objects and others are accomplished in embodiments by providing a substrate coating method comprising:

(a) enclosing a portion of a substrate in a sleeve member to define a gap between the outer surface of the substrate and the inner surface of the sleeve member;

(b) positioning below the surface of a coating solution a portion of the sleeve member and a portion of the substrate and filling a portion of the gap with the coating solution, whereby a part of the sleeve member outer surface, a part of the sleeve member inner surface, and a part of the substrate outer surface contact the coating solution; and (c) withdrawing the coating solution from the gap and leaving a portion of the coating solution adhering to the outer surface of the substrate.

In embodiments of the instant invention, there is also provided a substrate coating method comprising:

(a) enclosing a portion of a cylindrical substrate in a cylindrical sleeve member having an open end to define a gap between the outer surface of the substrate and the inner surface of the sleeve member in communication with the open end;

(b) positioning below the surface of a coating solution disposed in a vessel a portion of the sleeve member including the open end and a portion of the substrate and filling a portion of the gap through the open end of the sleeve member with the coating solution that is disposed beneath the solution surface, whereby a part of the sleeve member outer surface, a part of the sleeve member inner surface, and a part of the substrate outer surface contact the coating solution; and (c) withdrawing the coating solution from the gap through the open end of the sleeve member and leaving a portion of the coating solution adhering to the outer surface of the substrate.

BRIEF DESCRIPTION OF THE DRAWINGS

Other aspects of the present invention will become apparent as the following description proceeds and upon reference to the Figures which represent preferred embodiments.

Unless otherwise noted, the same reference numeral in the Figures refers to the same or similar feature.

DETAILED DESCRIPTION

Figure 1:
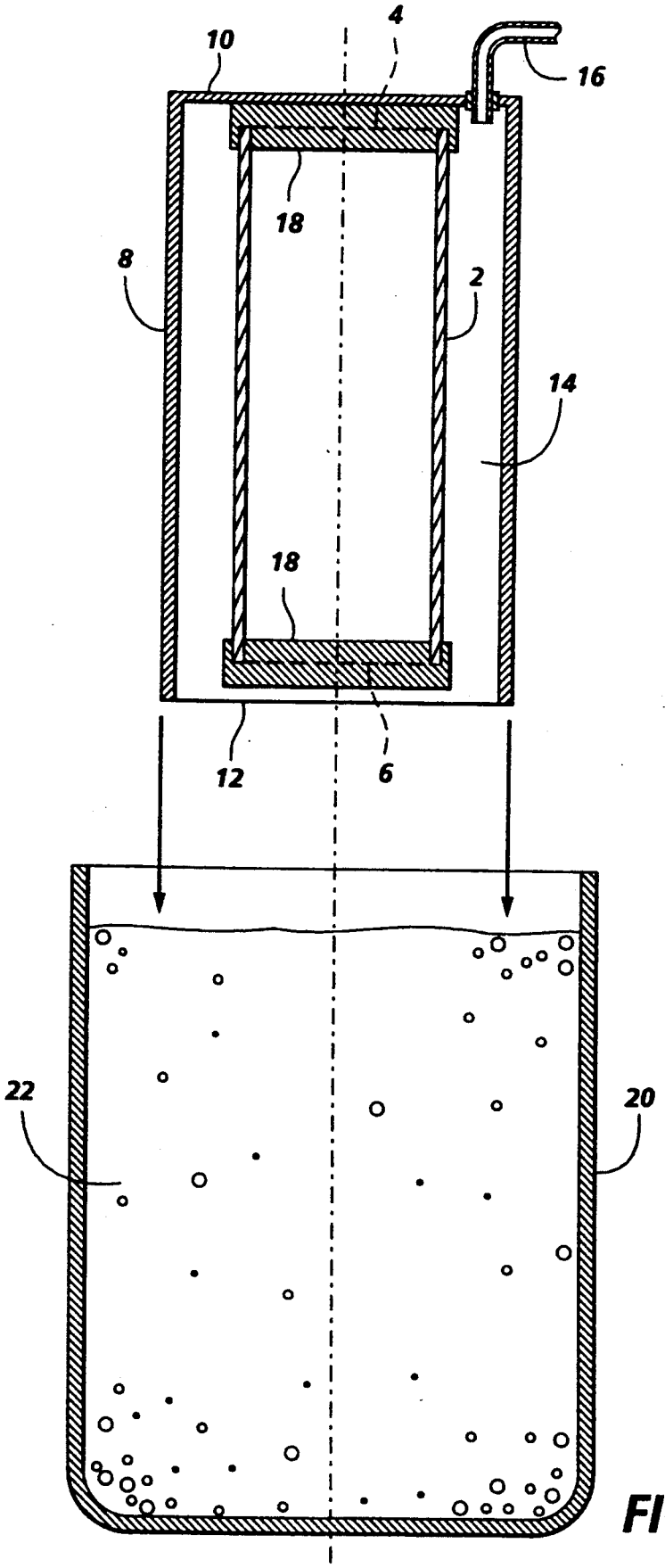
FIG. 1 illustrates a cross-sectional, schematic view of an assembly comprised of a substrate and the sleeve member.

In FIG. 1, a portion of substrate 2 having a top end 4 and a bottom end 6 is enclosed in sleeve member 8 having a top end 10 and a bottom end 12 to define a gap 14 between the outer surface of the substrate 2 and the inner surface of the sleeve member 8. The gap 14 may be annularly-shaped and may have a width ranging in size for instance from about 5 mm to about 7 cm, and preferably from about 10 mm to about 2 cm. Preferably, the entire length of the substrate is surrounded by the sleeve member and the gap may be present along the entire length of the substrate. The bottom end 12 of the sleeve member may be open and is in communication with the gap 14. The bottom end 12 of the sleeve member may coincide with the bottom end 6 of the substrate or may extend beyond the bottom end of the substrate by a length ranging for example from about 5 mm to about 10 cm. The top end 10 of the sleeve member may be sealed and is fitted with an air outlet channel 16 coupled to a controllable air bleed valve (not shown). The air outlet channel 16 may be a pipe and is in communication with the gap 14 at one end and in communication with ambient air at the other end. The top end 4 of the substrate may be sealed with a removable end cap 18 and the end cap may be coupled to the top end of the sleeve member by any appropriate method and apparatus including for example the use of adhesive, welding, and/or a fastening device like a screw, rivet, or bolt. The bottom end 6 of the substrate is preferably sealed with a removable end cap 18 to prevent entry of the coating solution 22 into substrate interior. The end cap 18 may be a pressure fitting using an O-ring or a rubber bladder seal. Each end cap preferably prevents an end region of the substrate, for example about ½ inch, from being coated.

The sleeve member and the substrate, both of which may be vertically oriented, are lowered bottom ends first into a vessel 20 containing the coating solution 22. In embodiments, the vessel 20 may be raised to meet the sleeve member and the substrate. Preferably, a portion of the length of the sleeve member 8 ranging for example from about 80% to 100% may be disposed underneath the surface of the coating solution. Similarly, a portion of the length of the substrate ranging for example from about 80% to 100% may be disposed underneath the surface of the coating solution. The bottom ends of the sleeve member and the substrate are preferably adjacent the bottom surface of the vessel and spaced a distance, ranging for example from about 5 mm to about 10 cm, and preferably from about 10 mm to about 2 cm, from the bottom surface of the vessel to permit the flow of coating solution into the bottom end of the sleeve member and into the gap. In embodiments of the instant invention, the valve is closed to prevent the exit of air from the gap into the air outlet channel during the positioning of the sleeve member and the substrate into the coating solution, thereby preventing the coating solution from entering the open bottom end of the sleeve member.

Figure 2:
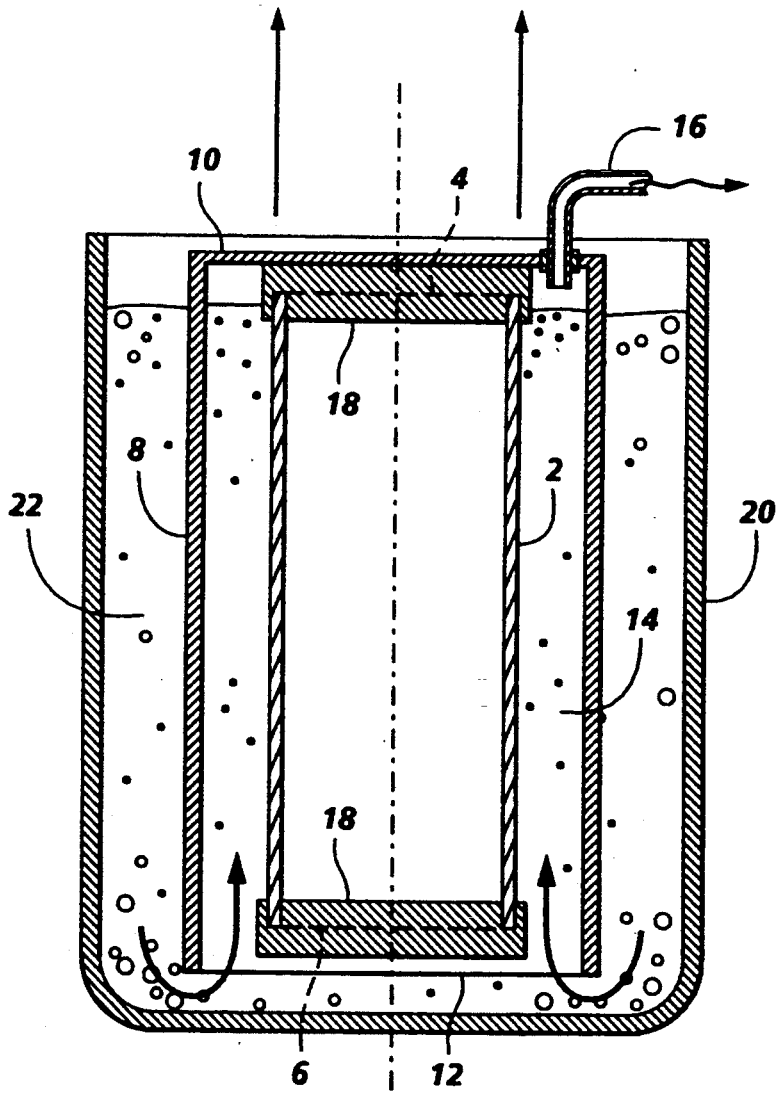
FIG. 2 illustrates a cross-sectional, schematic view depicting the coating of the substrate.

In FIG. 2, after the positioning of the sleeve member 8 and the substrate 2 into the coating solution 22, the valve (not shown) is opened which results in entry of the coating solution into the open bottom end 12 of the sleeve member and into the gap 14 since the air in the gap, which is being displaced by the coating solution, may exit into the air outlet channel 16. The rate of entry of the coating solution into the open bottom end 12 of the sleeve member and the gap preferably may be controlled by adjusting the valve to regulate the amount of air exiting into the air outlet channel from the gap. The coating solution fills a portion of the gap, preferably until the coating solution is in contact with a part of the outer surface of the substrate ranging for example from about 70% to 100%.

In embodiments of the instant invention, the valve may be opened to commence entry of the coating solution into the open bottom end of the sleeve member and into the gap during movement of the sleeve member and the substrate into the coating solution, preferably subsequent to movement of the bottom end of the sleeve member past the surface of the coating solution to minimize entry of surface contaminates.

To complete the coating process, the coating solution is withdrawn from the gap 14 to leave a portion of the coating solution adhering to the outer surface of the substrate 2. This may be accomplished by any suitable way including the following. In a first embodiment, the valve is open and the sleeve member and the substrate are withdrawn at a controlled rate, whereby the coating solution from the gap will exit through the open bottom end of the sleeve member under the influence of gravity and air will enter the gap from the air outlet channel to displace the coating solution. The sleeve member and the substrate may be withdrawn from the coating solution at a rate ranging for example from about 0.5 mm per second to about 2 mm per second. In a second embodiment, the valve is closed to prevent the entry of air into the gap from the air outlet channel as the sleeve member and the substrate are withdrawn from the coating solution, thereby preventing the exit of coating solution from the gap into the vessel through the open bottom end of the sleeve member. The valve may be then opened at any time during movement of the sleeve member and the substrate out of the coating solution including subsequent to the complete removal of the sleeve member and the substrate from the coating solution. When the valve is opened in this second embodiment, the coating solution from the gap will exit through the open bottom end of the sleeve member under the influence of gravity and air will enter the gap from the air outlet channel to displace the coating solution. The rate of withdrawal of the coating solution from the gap may be controlled by adjusting the valve to regulate the amount of air entering into the gap from the air outlet channel. Withdrawal of the coating solution from the gap by the methods disclosed herein leaves behind a portion of the coating solution which adheres to the substrate surface in a layer having a thickness ranging for example from about 3 to about 100 microns.

The thickness of the coating solution deposited on the substrate depends upon the rate at which the coating solution is withdrawn from the gap and on the viscosity of the coating solution. There are several ways to control the rate at which the coating solution is withdrawn from the gap, and thereby regulate the thickness of the coated layer. For example, the rate of air entering the gap from the air outlet channel may be controlled via the valve. Also, a controlled rate of removal of the sleeve member and the substrate from the coating solution can affect the coating thickness, especially for those embodiments where the valve is open to allow air to displace the coating solution in the gap.

The instant invention facilitates drying of the coating solution adhering to the substrate surface since air (cooled, ambient, or heated) may be blown into the gap through the air outlet channel. The dried substrate coating has a thickness which ranges for example from about 3 to about 100 microns.

The coated substrate may be decoupled from the sleeve member and from the removable end caps.

The instant invention may offer several benefits. First, by allowing in embodiments only the coating solution disposed beneath the solution surface to enter the gap to contact the substrate outer surface, the present invention may minimize or eliminate the effect of vibrational energy at the coating solution surface. Vibrational energies are minimized because the sleeve acts as a barrier to their transmission to the substrate. Minimizing or eliminating the effect of vibrational energy allows a more uniform coating. Second, by allowing in embodiments only the coating solution disposed beneath the solution surface to enter the gap to contact the substrate outer surface, the present invention may minimize or eliminate the possiblity of solution surface contaminates being deposited on the substrate. In the vessel, contaminates such as dust, oil, and any foreign material which might float on the coating solution, may be present substantially or entirely on the surface of the coating solution. Third, as discussed above, the use of an air bleed valve in embodiments allows some control over the rate of withdrawal of the coating solution from the gap which in turn may influence the thickness of the coating solution remaining on the substrate surface. Fourth, as discussed above, the present invention may facilitate in embodiments the drying of the coating solution adhering to the substrate surface.

The coating method of the instant invention may be employed on a substrate having an outer surface devoid of layered material or on a substrate having an outer surface previously coated with a layered material, including the materials described herein. The substrate may be of any suitable configuration and dimensions. Preferably, the substrate is cylindrical, rigid, and/or hollow. In embodiments, the substrate may be a belt. The substrate may be fabricated from any suitable material including a plastic or a metal like stainless steel, aluminum, nickel, copper, brass, and the like. Illustrative dimensions for the substrate are as follows: a length ranging for example from about 5 cm to about 25 cm; an outer cross-sectional dimension ranging for example from about 20 mm to about 15 cm; and a wall thickness ranging for example from about 2 mm to about 2

The sleeve member may be of any suitable configuration and dimensions. Preferably, the sleeve member is cylindrical, rigid, and/or hollow. The sleeveless member may be fabricated from any suitable material including a plastic or a metal like stainless steel, aluminum, nickel, copper, brass, and the like. Illustrative dimensions for the sleeveless member are as follows: a length ranging for example from about 5 cm to about 25 cm; an outer cross-sectional dimension ranging for example from about 20 mm to about 15 cm; and a wall thickness ranging for example from about 2 mm to about 2 cm.

The coating solution may comprise any composition typically employed in the fabrication of electrostatographic photosensitive members. One or more of the following layers may be successively deposited in any order on the substrate using the present invention: an adhesive layer, a blocking layer, a charge generating layer, a charge transport layer, and any other layer typically employed in photosensitive members. In embodiments, a charge transport layer such as an arylamine, reference for example U.S. Pat. No. 4,265,990, the disclosure of which is totally incorporated by reference, and a charge generating layer comprise the photosensitive layers. This is referred to as a laminate or layered type photosensitive material. Charge transport and charge generating layers are well known in the art as illustrated for example in U.S. Pat. Nos. 4,390,611; 4,551,404; 4,588,667; 4,596,754; and 4,797,337, the disclosures of which are totally incorporated by reference. In embodiments, the charge generating layer may be formed by dispersing a charge generating material selected from, for example, azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochloro-phthalocyanine, and the like; quinacridone pigments; or azulene compounds in a binder resin such as polyester, polystyrene, polyvinyl butyral, polyvinyl pyrrolidone, methyl cellulose, polyacrylates, cellulose esters, and the like. In embodiments, the charge transport layer may be formed by dissolving a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and the like, and hydrazone compounds in a resin having a film-forming property. Such resins may include polycarbonate, polymethacrylates, polyarylate, polystyrene, polyester, polysulfone, styrene-acrylonitrile copolymer, styrene-methyl methacrylate copolymer, and the like.

In embodiments, the photosensitive material may be of a single-layer type comprising the charge generating material, charge transporting material, and the binder resin, wherein these three materials may be as described above. Single layer type photosensitive materials are illustrated, for example, in Mutoh et al., U.S. Pat. No. 5,004,662 and Nishiguchi et al., U.S. Pat. No. 4,965,155, the disclosures of which are totally incorporated by reference.

Other modifications of the present invention may occur to those skilled in the art based upon a reading of the present disclosure and these modifications are intended to be included within the scope of the present invention.

I claim:

1. A substrate coating method comprising:

(a) enclosing a portion of a substrate in a sleeve member to define a gap between the outer surface of the substrate and the inner surface of the sleeve member;

(b) positioning below the surface of a coating solution a portion of the sleeve member and a portion of the substrate and filling a portion of the gap with the coating solution, whereby a part of the sleeve member outer surface, a part of the sleeve member inner surface, and a part of the substrate outer surface contact the coating solution; and (c) withdrawing the coating solution from the gap and leaving a portion of the coating solution adhering to the outer surface of the substrate.

2. A substrate coating method comprising:

(a) enclosing a portion of a cylindrical substrate in a cylindrical sleeve member having an open end to define a gap between the outer surface of the substrate and the inner surface of the sleeve member in communication with the open end;

(b) positioning below the surface of a coating solution disposed in a vessel a portion of the sleeve member including the open end and a portion of the substrate and filling a portion of the gap through the open end of the sleeve member with the coating solution that is disposed beneath the solution surface, whereby a part of the sleeve member outer surface, a part of the sleeve member inner surface, and a part of the substrate outer surface contact the coating solution; and (c) withdrawing the coating solution from the gap through the open end of the sleeve member and leaving a portion of the coating solution adhering to the outer surface of the substrate.

3. The method of claim 2, further comprising sealing the top end and the bottom end of the substrate.

4. The method of claim 2, wherein (a) comprises enclosing the entire substrate in the sleeve member.

5. The method of claim 2, wherein (b) comprises positioning the open end of the sleeve member below the surface of the coating solution and adjacent the bottom surface of the vessel.

6. The method of claim 2, wherein (b) comprises moving downwards the sleeve member and the substrate into the coating solution.

7. The method of claim 2, wherein (b) comprises moving upwards a vessel containing the coating solution to position the portion of the sleeve member and the portion of the substrate below the solution surface.

8. The method of claim 2, wherein (b) comprises commencing the filling of the portion of the gap with the coating solution subsequent to the positioning of the portion of the sleeve member and the portion of the substrate beneath the surface of the coating solution to minimize entry of the portion of the coating solution at the solution surface into the open end and the gap.

9. The method of claim 2, further comprising positioning the sleeve member and the substrate in a vertical orientation during (b).

10. The method of claim 2, wherein (b) comprises filling the portion of the gap with the coating solution which is free of surface contaminates.

11. The method of claim 2, wherein (c) comprises withdrawing the coating solution from the gap by displacing the coating solution with air.

12. The method of claim 2, wherein (c) comprises commencing the withdrawal of the coating solution from the gap during removal of the sleeve member and the substrate from the coating solution.

13. The method of claim 2, wherein (c) comprises commencing the withdrawal of the coating solution from the gap subsequent to removal of the sleeve member and the substrate from the coating solution.

* * * * *